United States Patent [19]

Yamamoto

[11] Patent Number: 4,968,266

[45] Date of Patent: Nov. 6, 1990

[54] SURFACE MOUNT CONNECTOR

[75] Inventor: Masahiro Yamamoto, Yokohama, Japan

[73] Assignee: Thomas & Betts Corporation, Bridgewater, N.J.

[21] Appl. No.: 314,723

[22] Filed: Feb. 23, 1989

[30] Foreign Application Priority Data

Feb. 23, 1988 [JP] Japan ..... 63-38761

[51] Int. Cl.[5] ..... H01R 13/52; H01R 13/62

[52] U.S. Cl. ..... 439/271; 439/325; 439/630

[58] Field of Search ..... 439/328, 329, 635, 76, 439/79, 80, 325, 449, 595, 629, 630, 59, 62, 632, 271

[56] References Cited

U.S. PATENT DOCUMENTS

| | | | |
|---|---|---|---|
| Re. 28,509 | 8/1975 | Piechocki et al. | 228/180 |
| 2,923,911 | 2/1960 | Demurjian | 439/329 |
| 2,928,063 | 3/1960 | Gammel, Sr. | 439/329 |
| 3,107,961 | 10/1963 | Hahn et al. | 439/59 |
| 3,516,155 | 6/1970 | Smith | 29/626 |
| 3,540,718 | 11/1970 | Heffron et al. | 269/254 |
| 3,552,630 | 1/1971 | Dean | 228/46 |
| 3,589,591 | 6/1971 | Schwenn | 228/44 |
| 3,673,664 | 7/1972 | Niese | 29/203 |
| 3,823,863 | 7/1974 | Piechocki | 228/6 |
| 3,995,845 | 12/1976 | Scheffer | 269/254 |
| 4,125,216 | 11/1978 | Ozimec | 228/4.5 |
| 4,505,035 | 3/1985 | Burton et al. | 29/843 |
| 4,676,575 | 6/1987 | Denlinger et al. | 439/271 |
| 4,703,920 | 11/1987 | Grabbe et al. | 269/37 |
| 4,734,042 | 3/1988 | Martens et al. | 439/62 |
| 4,781,612 | 11/1988 | Thrush | 439/328 |

*Primary Examiner*—Steven C. Bishop

*Attorney, Agent, or Firm*—Robert M. Rodrick; Salvatore J. Abbruzzese

[57] ABSTRACT

The surface mount connector comprises male and female interconnectable housings. The male housing includes a plurality of male contacts that are connected to a plurality of wires and the female housing accommodates a plurality of female contacts for receiving and holding the male contacts in assembly. The female contacts each further include a resilient lead for surface mount connection to a conductive electrode disposed on a printed circuit board surface. The female housing further includes a connection portion that in a preferred form, includes slots formed in flanges extending outwardly from the female housing, the slots in the flanges being adapted to receive and resiliently hold the printed circuit board therein while the leads of the female contacts are attached to the conductive electrodes on the printed circuit board.

4 Claims, 4 Drawing Sheets

SURFACE MOUNT CONNECTOR

FIELD OF THE INVENTION

The present invention relates to electrical connectors, and more particularly, to connectors mounted on a surface, for example, of a printed circuit board.

BACKGROUND OF THE INVENTION

There are printed circuit boards, for example, of a ceramic material which can withstand use under severe conditions, such as thermal environments. Connectors mounted on such a printed board must be mounted securely by designing the connector structure considering that the printed board itself could be broken. The connection between the contacts of a connector or terminals and a pattern (electrodes) on the board is effected by putting contacts on solder before being attached to the pattern, heating the solder to solder together the contact or terminals and the pattern. To achieve this connection the connector must be held during soldering.

SUMMARY OF THE INVENTION

The present invention has been developed to satisfy the above requirements.

The present invention mounts electronic parts such as a connector, onto a ceramic board or the like to thereby form a package of electronic parts and widen applications of the ceramic board.

In accordance with a preferred form of the invention, a surface mount connector comprises first and second connector housings, the first connector housing supporting a plurality of male contacts to be connected to wires, the male contacts being held removably within the first connector housing with the contact end portions extending therethrough. A plurality of female contacts are accommodated within the second connector housing, each female contact having means for receiving and holding the end portion of a corresponding male contact. The female contacts further include a resilient lead for contacting a conductive electrode disposed on a surface of a substrate, such as a printed circuit board. The second connector housing further includes a connection portion for resiliently receiving and holding the substrate, the female contact lead portions adapted to be placed into contact with the electrodes of the substrate to thereby establish electrical connection when the substrate is inserted into the connection portion of the second connector housing.

DETAILED DESCRIPTION OF THE PREFERRED EMBODIMENT

Figure 1:
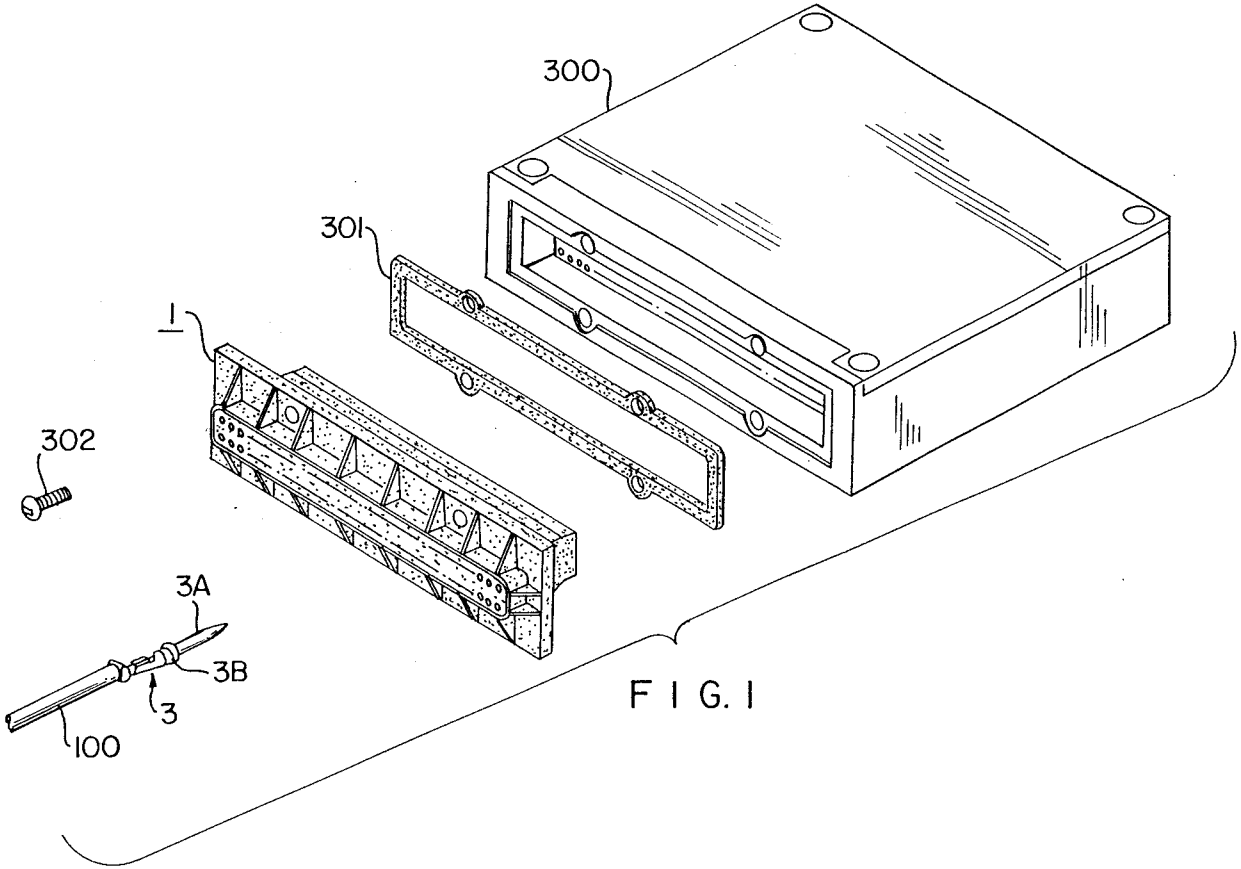
FIG. 1 is an exploded perspective view of a package using a connector according to the invention.

Referring now to the drawing figures, there is shown in FIG. 1 an exploded view of a package in which a connector according to the present invention is mounted. In FIG. 1, reference numeral 1 denotes a male housing of the connector according to the present invention and to be described in more detail hereinbelow. A female housing 2 (FIG. 2) of the inventive connector is mounted within a unit casing 300, and is not shown in FIG. 1. Reference numeral 301 denotes a waterproof rubber seal.

Reference numeral 100 denotes a wire material as a connected member. Reference numeral 3 denotes a male conductive contact which terminates the wire material. Reference numeral 302 denotes a screw which fixes the male housing to the unit casing.

Figure 2:
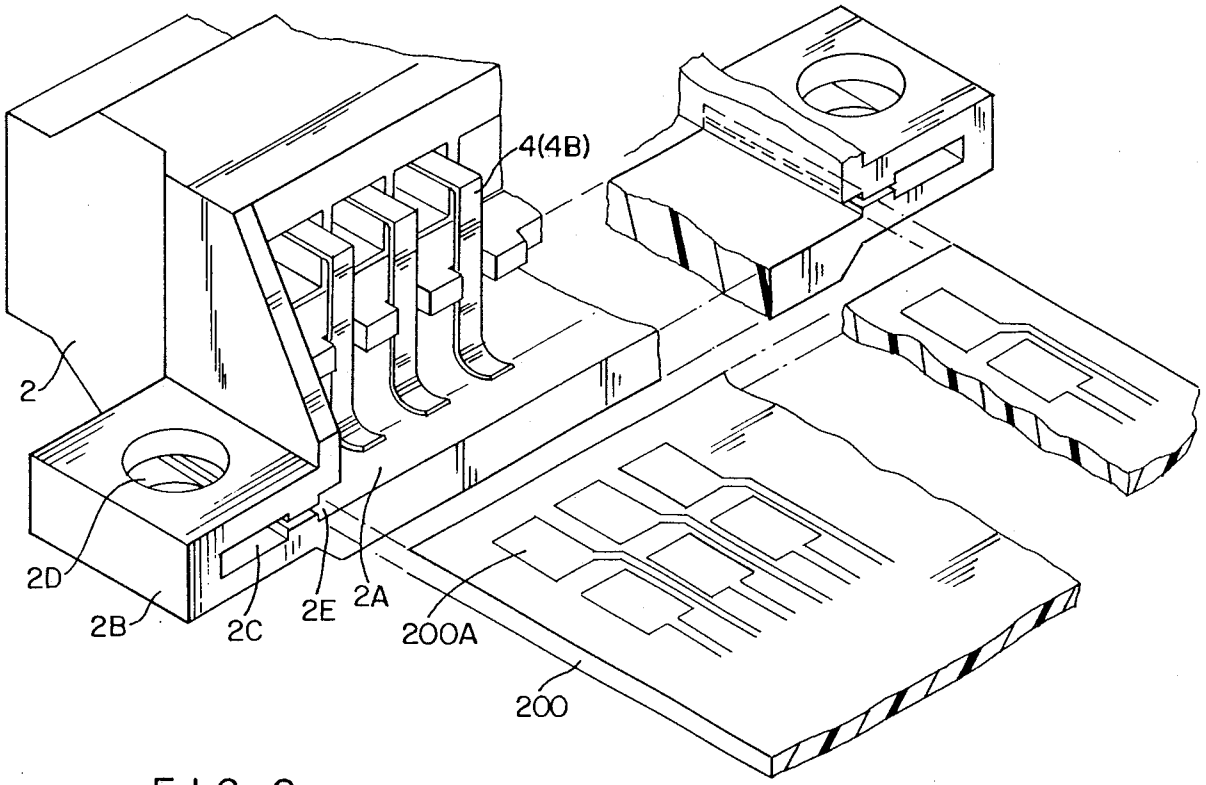
FIG. 2 is a perspective view showing the relationship between a connector according to the present invention and a board with several parts being omitted therefrom for clarity.

FIG. 2 shows the relationship between the female housing 2 of the connector of the present invention and a ceramic board 200.

The female housing 2 mounts therein female contacts 4, to be described in more detail hereinafter and has a connection portion 2A, which receives an end of the board 200 and is connected thereto. The connection portion 2A includes a groove 2E for receiving the board and flanges 2B which each have a slot 2C opening outwardly from the housing. The slot 2C in the flange communicates with the groove 2E which receive the board and functions as a spring to open when it receives the board to thereby hold the board securely. The flanges 2B each have a hole 2D through which a screw is inserted to fix the connector to the casing 300.

Figure 3:
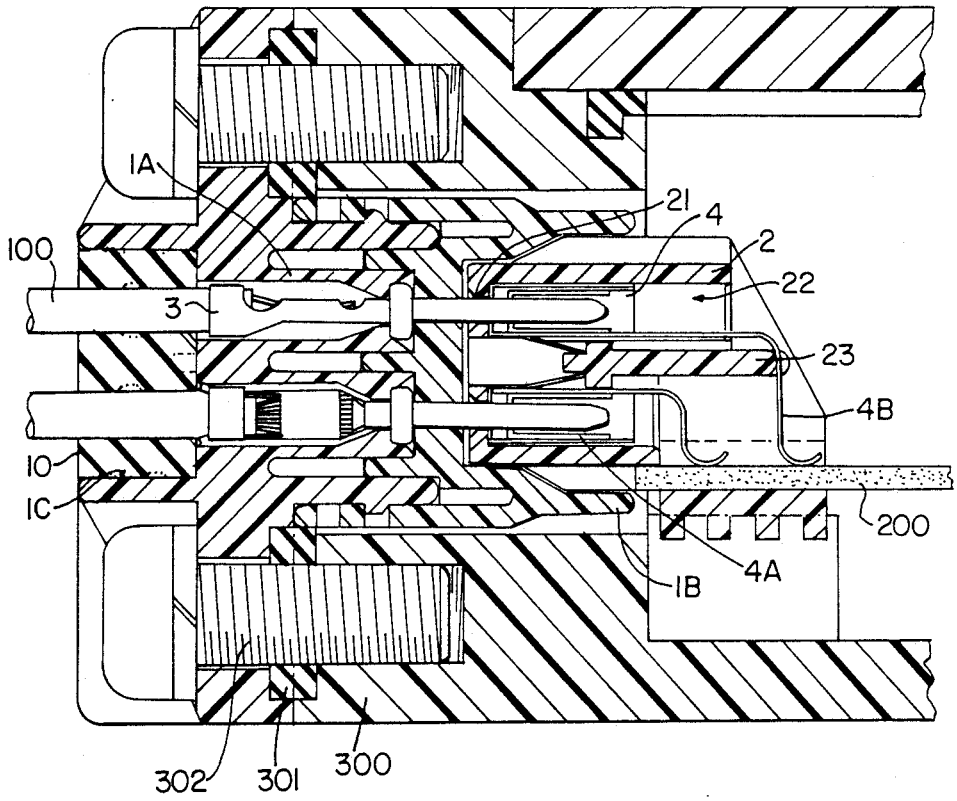
FIG. 3 is a cross sectional view of a mounted connector according to the present invention.

FIG. 3 is a cross sectional view of the inventive connector mounted on the board 200 with the wires 100 being connected to the connector.

The male housing 1 includes lance-like retainers 1A to receive the corresponding male contacts 3 of pieces of wire 100 and a stop 1B mating with the retainers to hold the male contacts received in the retainers 1A.

The male housing has an opening 1C through which the pieces of wire 100 are guided to the retainer 1A. In the particular embodiment, the opening is sealed with a rubber bushing 10 to fulfill a waterproof function for the connector together with a rubber seal 301 intervening between the fitting portions of the male and female housings.

Ends 3A of the male contacts on the pieces of wire 100 extend through the retainers 1A and are engaged at their shoulders 3B with the lances of the corresponding retainers.

The female housing 2 includes openings 21 which guide therethrough the ends of the corresponding male contacts extending from the male housing, and a cavity 22 communicating with the openings 21 and accommodating the female conductive contacts 4 electrically connected to the corresponding male contacts.

Each female contact 4 includes a retainer 4A for receiving and holding the end portion 3A of the corresponding male contact, and an resilient conductive lead 4B extending from the back of the female housing and contacting a conductive electrode 200A, for example, of a printed board.

In FIG. 3, reference numeral 23 denotes a spacer to space female contacts at predetermined intervals within the cavity 22 and made integrally with the female housing.

When a printed board 200 is inserted into the connection portion 2A of the female housing, the conductive pattern 200A on the printed board contacts the leads 4B of the female contacts, (which is performed effectively by bending the ends of the leads, as shown), and the board is held in the slots 2C in the connection portions by the gripping operation of the slots 2C.

Figure 4:
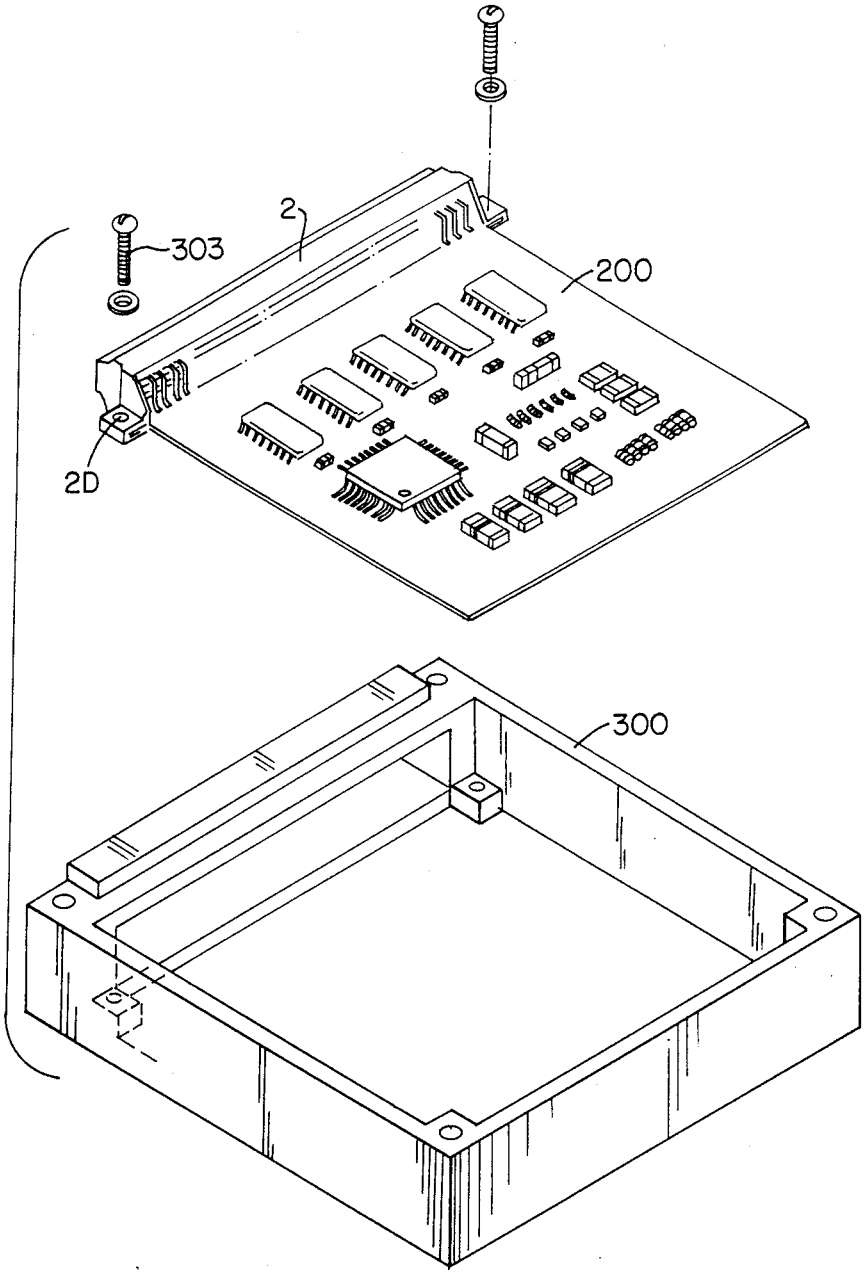
FIG. 4 is a perspective view illustrating the use of a connector according to the present invention.

FIG. 4 illustrates the accommodation, within the unit casing 300, of a board on which connections according to the invention are mounted. Screws 303 are threaded through mounting holes 2D in the flanges of the female housing into the unit casing 300.

By the above arrangement described in detail, the inventive connectors are mounted securely and easily on a fragile ceramic board. Even if an external force is applied through pieces of wire to the inventive connector, such force is not applied to the board because the connector housing itself has a structure in which it holds and connects the board.

Having described the preferred embodiments herein, it should be appreciated that variations thereof may be made within the contemplated scope of the invention. Accordingly, the embodiments described herein are illustrative rather than limiting, the true scope of the invention being set forth in the claims appended hereto.

I claim:

1. A surface mount connector comprising:

first (1) and second (2) connector housings:

a plurality of male contacts (3) to be connected to wires 100, said male contacts being held removably within said first connector housing so as to have an end portion extending therethrough; and a plurality of female contacts (4) accommodated within said second connector housing, each female contact having means for receiving and holding the end portion of a corresponding male contact extending through said first housing and a resilient lead (4B) for contacting a conductive electrode (200A) disposed on a surface of a substrate (200), such as a printed circuit board;

said second connector housing having a connection portion (2A) for resiliently receiving and holding said substrate 200, said connection portion (2A) including a flange (2B) having a slot (2C) opening outwardly from the housings, said slot (2C) adapted to resiliently grip said substrate (200), said female contact lead portions adapted to be placed into contact with the electrodes of the substrate to thereby establish electrical connection when the substrate is inserted into the connection portion of the said second connector housing.

2. A surface mount connector according to claim 1, wherein said first connector housing includes a plurality of lance-like retainers (1A), each for receiving the corresponding male contacts and a stop (1B) for actuating the retainer to hold the corresponding male contact received by the retainer.

3. A surface mount connector according to claim 1 or 2, wherein said first connector housing has an opening (1C) for sealing and inserting wires therethrough.

4. A surface mount connector according to claim 1 or 2, wherein said flange (2B) has a through hole (2D) to accommodate a fastening element therethrough.

* * * * *